US008836239B2

(12) United States Patent
Hamamoto et al.

(10) Patent No.: US 8,836,239 B2
(45) Date of Patent: Sep. 16, 2014

(54) LED LIGHTING DEVICE AND ILLUMINATION APPARATUS INCLUDING SAME

(75) Inventors: Katunobu Hamamoto, Neyagawa (JP); Masafumi Yamamoto, Kyoto (JP); Keisuke Ueda, Hirakata (JP); Hisaya Takikita, Habikino (JP)

(73) Assignee: Panasonic Corporation, Osaka (JP)

( * ) Notice: Subject to any disclaimer, the term of this patent is extended or adjusted under 35 U.S.C. 154(b) by 72 days.

(21) Appl. No.: 13/324,219

(22) Filed: Dec. 13, 2011

(65) Prior Publication Data

US 2012/0153863 A1 Jun. 21, 2012

(30) Foreign Application Priority Data

Dec. 20, 2010 (JP) ..... 2010-283642

(51) Int. Cl.
*H05B 37/02* (2006.01)
*H05B 33/08* (2006.01)

(52) U.S. Cl.
CPC ..... *H05B 33/0815* (2013.01)
USPC ..... 315/307; 315/291; 315/360; 315/227 R; 315/238

(58) Field of Classification Search
USPC ..... 315/209 R, 224, 225, 227 R, 291, 307, 315/308
See application file for complete search history.

(56) References Cited

U.S. PATENT DOCUMENTS

2007/0182347 A1* 8/2007 Shteynberg et al. ..... 315/312
2008/0136350 A1* 6/2008 Tripathi et al. ..... 315/294
2008/0297058 A1* 12/2008 Soos ..... 315/185 R
2009/0174342 A1* 7/2009 Maxik ..... 315/291
2010/0026208 A1* 2/2010 Shteynberg et al. ..... 315/297
2010/0213859 A1* 8/2010 Shteynberg et al. ..... 315/224
2010/0327765 A1* 12/2010 Melanson et al. ..... 315/291
2011/0254457 A1 10/2011 Marent et al.

FOREIGN PATENT DOCUMENTS

CN 101777770 A 7/2010
EP 2 257 129 12/2010
JP 2006-210271 8/2006
WO 2010/046055 4/2010

OTHER PUBLICATIONS

Extended European search report dated Apr. 17, 2012.
Chinese Office Action dated Jun. 19, 2014, for CN 201110426564.8, and English translation thereof.

* cited by examiner

*Primary Examiner* — Thienvu Tran
*Assistant Examiner* — Christopher Lo
(74) *Attorney, Agent, or Firm* — Bacon & Thomas, PLLC

(57) ABSTRACT

An LED lighting device includes a converter for converting a power source voltage into a DC voltage and outputting it to an LED unit; and a controller for controlling an output of the converter. The converter has a chopper circuit including a series circuit of an inductance element and a capacitor; a switching element connected to the inductance element in series and turned on/off by the controller; and a diode as discharging path of the inductance element during an OFF state of the switching element. The controller controls an on/off time of the switching element such that a current supplied to the LED unit during a specific time period after a lighting operation is started becomes smaller than a current supplied to the LED unit in a steady state by using a voltage generated in a secondary coil of the inductance coil as an operating voltage thereof.

8 Claims, 2 Drawing Sheets

LED LIGHTING DEVICE AND ILLUMINATION APPARATUS INCLUDING SAME

FIELD OF THE INVENTION

The present invention relates to an LED lighting device and an illumination apparatus including the same.

BACKGROUND OF THE INVENTION

Conventionally, there has been disclosed an LED lighting device for supplying a power to an LED unit (see, e.g., Japanese Patent Application Publication No. 2006-210271 (JP2006-210271A), paragraphs [0031] to [0036] and FIG. 1). The LED lighting device includes a lighting circuit unit for converting a voltage inputted from a DC power supply to a predetermined DC voltage and outputting the DC voltage; a protection circuit unit for suppressing a rapid change in an output voltage in the lighting circuit unit; a voltage detecting circuit unit for detecting an output voltage from the lighting circuit unit; and a current detecting resistor for detecting a current flowing through the LED unit.

The lighting circuit unit includes an inductance element having a first terminal connected to a high-voltage port of the DC power supply; a backward current blocking diode having an anode connected to a second terminal of the inductance element; a switching element connected between the second terminal of the inductance element and a low-voltage port of the DC power supply; a capacitance element connected between a cathode of the backward current blocking diode and the low-voltage port of the DC power supply; and an operation controller for controlling an output voltage from the lighting circuit unit.

In this LED lighting device, the output voltage from the lighting circuit unit is adjusted such that a current flowing through the LED unit reaches a preset desired value, by allowing the operation controller to detect a current flowing through the LED unit by using the current detecting resistor and feeding back the detection result for on and off control of the switching element. Accordingly, even when the voltage of the DC power supply is varied, it is possible to keep the LED unit to have a uniform brightness.

When the LED lighting device disclosed in JP2006-210271A is operated, a current flowing through the inductance element becomes accumulated in the capacitance element. At this time, if a large current is supplied to the LED unit, the voltage of the capacitance element is smoothly increased. Moreover, in the case that an operating power of the operation controller is supplied from an output side of the lighting circuit unit, a control current from the operating power is also smoothly raised in proportion to the smooth increase in the voltage of the capacitance element. As a result, it would take time for the operating power of the operation controller to be stabilized.

Furthermore, when the control current from the operating power is designed to be steeply increased, a current supplied to the operation controller may be raised, thereby increasing power losses in the operating power or in the operation controller.

SUMMARY OF THE INVENTION

In view of the above, the present invention provides an LED lighting device and an illumination apparatus using the same, capable of reducing a time period that it takes for an operating power of an output controller to be stabilized.

In accordance with an aspect of the present invention, there is provided an LED lighting device including a power converting unit for converting a power source voltage to a DC voltage and outputting the DC voltage to an LED unit; and an output control unit for controlling an output from the power converting unit. The power converting unit has a chopper circuit including a series circuit of an inductance element and a capacitor; a switching element which is connected to the inductance element in series and turned on and off by the output control unit; and a diode serving as a discharging path of the inductance element during an OFF state of the switching element. The output control unit controls an on and off time of the switching element in such a way that a current supplied to the LED unit during a specific time period after a lighting operation is started becomes smaller than a current supplied to the LED unit in a steady state by using a voltage generated in a secondary coil of the inductance coil as an operating voltage thereof.

The output control unit may use a positive voltage generated in the secondary coil as the operating voltage thereof when charges accumulated in the inductance element are discharged.

The output control unit may control the operation of the switching element in a critical mode where the switching element is turned on at the time when a current flowing through the inductance element becomes zero, and use the secondary coil to detect the current flowing through the inductance element.

In accordance with another aspect of the present invention, there is provided an illumination apparatus including the LED lighting device; lamp sockets to which the LED unit is mechanically electrically connected; and an apparatus body for holding the LED lighting device and the lamp sockets.

In accordance with the present invention, it is possible to provide an LED lighting device and an illumination apparatus using the same, capable of reducing a time period that it takes for an operating power of an output controller to be stabilized.

BRIEF DESCRIPTION OF THE DRAWINGS

The objects and features of the present invention will become apparent from the following description of embodiments, given in conjunction with the accompanying drawings, in which.

DETAILED DESCRIPTION OF THE EMBODIMENTS

An LED lighting device and an illumination apparatus including the same in accordance with an embodiment of the present invention will now be described in reference to FIGS. 1 to 4.

Figure 1:
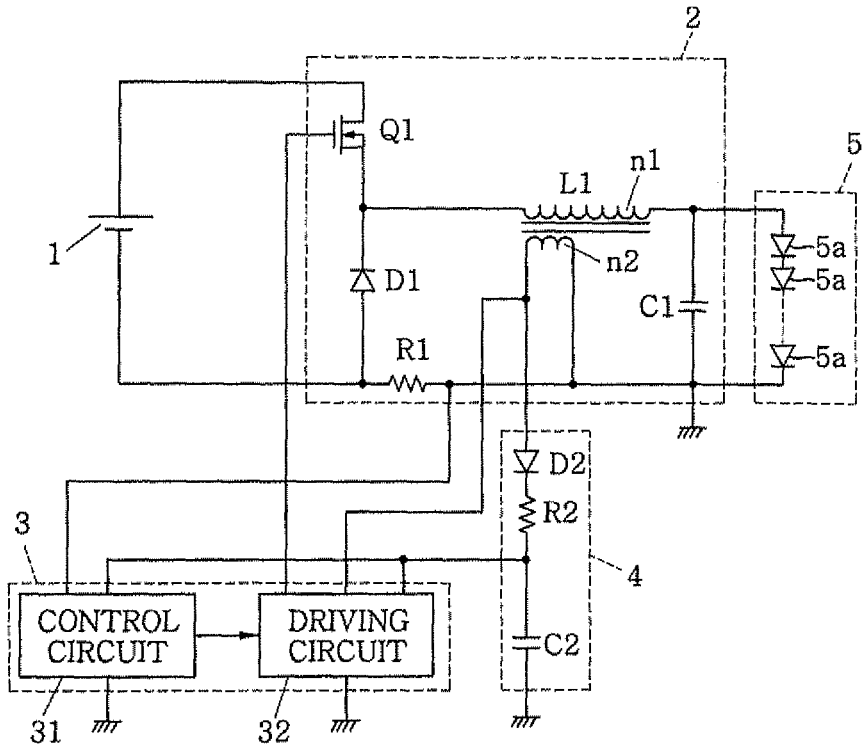
FIG. 1 is a schematic circuit diagram showing an LED lighting device in accordance with an embodiment of the present invention.

The LED lighting device of the present embodiment, as shown in FIG. 1, includes a power converting unit 2 for converting an output voltage from a DC power supply 1 to a predetermined DC voltage and outputting the DC voltage to an LED lamp (LED unit) 5; an output control unit 3 for controlling an output of the power converting unit 2; and a control power supply unit 4 for supplying an operating power to the output control unit 3.

The power converting unit 2 has a chopper circuit including a series circuit containing an inductance element L1 and a capacitor C1; a switching element Q1 (e.g., a bipolar transistor or a field effect transistor) which is connected to the inductance element L1 in series and turned on and off under the control of the output control unit 3; and a diode D1 serving as a discharging path of the inductance element L1 during an OFF state of the switching element Q1.

The output controller 3 includes a control circuit 31 for creating and outputting a control signal to adjust a current (load current) flowing through the LED lamp 5 by allowing a current value to be fed back so that the current value is made to reach a preset desired value; and a driving circuit 32 for driving the switching element Q1 of the power converting unit 2 based on the control signal outputted from the control circuit 31. Connected to the driving circuit 32 is a secondary coil n2 of the inductance element L1. Accordingly, by detecting a voltage generated in the secondary coil n2, a current flowing through a primary coil of the inductance element L1 can be detected. Connected to the control circuit 31 is one port (high-voltage side) of the resistor R1. Therefore, information on a voltage corresponding to a current flowing through the LED lamp 5 is inputted into the control circuit 31. This operation will be described later.

The control power supply unit 4 includes a series circuit having a resistor R2 and a capacitor C2 and a diode D2 having an anode connected to the secondary coil n2 of the inductance element L1 and a cathode connected to the resistor R2, and supplies to the output control unit 3 a voltage of the capacitor C2 accumulated by a voltage generated in the secondary coil n2 of the inductance element L1 serving as an operating voltage. In the present embodiment, as shown in FIG. 1, the coil for detecting a current flowing through the primary coil n1 of the inductance element L1 also serves as the secondary coil n2 for power supply. Accordingly, it is not necessary to additionally provide a coil for detecting such a current, thereby making it possible to provide an LED lighting device capable of suppressing a cost increase.

The LED lamp 5 includes a printed circuit board (not shown) in which a plurality of LEDs 5*a* are mounted in series; a long straight light emitting tube 5*b* (see FIG. 4) made of a transparent material (e.g., glass); and caps (not shown) respectively provided at opposite ends of the light emitting tube 5*b*. The printed circuit board is accommodated in the light emitting tube 5*b* and connected to at least one cap, so that the LEDs 5*a* are turned on by a DC power supplied from the power converting unit 2 through the cap.

Figure 2:
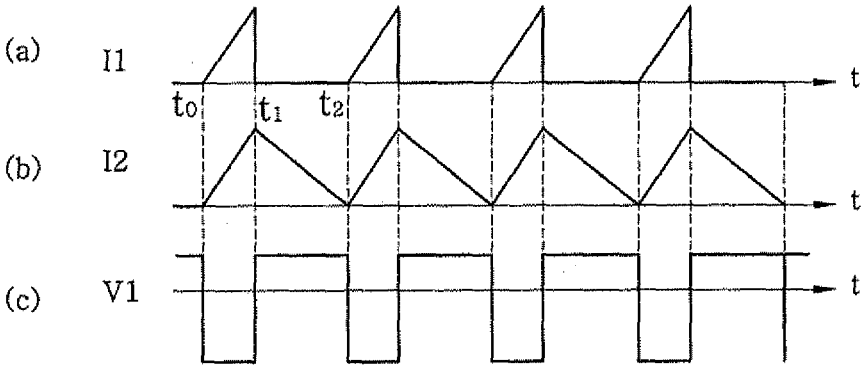
FIG. 2 shows graphs for explaining an operation of the LED lighting device.

Next, an operation of the LED lighting device will be described with reference to FIG. 2. Once the switching element Q1 of the power converting unit 2 is turned on at a time "t0" by a driving signal (on signal) outputted from the driving circuit 32 of the output control unit 3, a current "I1" is started to flow through the switching element Q1 and a current "I2" having the same magnitude as that of the current I1 flows through the inductance element L1. At this time, a negative voltage V1 is generated in the secondary coil n2 of the inductance element L1.

Then, once the switching element Q1 is turned off at a time "t1," the current I1 flowing through the switching element Q1 becomes zero. However, in the inductance element L1, an energy that was accumulated during the ON state of the switching element Q1 is discharged, which causes the current I2 to flow therethrough while being decreased proportionally with the passage of time (see (b) of FIG. 2). At this time, a positive voltage V1 is generated in the secondary coil n2 of the inductance element L1.

Then, once the current I2 flowing through the inductance element L1 becomes zero at a time "t2," the switching element Q1 is turned on again, so that the current I1 and the current I2 having the same magnitude as that of the current I1 are started to flow through the switching element Q1 and the inductance element L1, respectively. At this time, a negative voltage is generated in the secondary coil n2 of the inductance element L1.

In this way, the switching element Q1 is turned on and off repeatedly, so that a lighting power is accumulated in the capacitor C1. The LED lamp 5 is turned on by the accumulated lighting power.

In this embodiment, the output control unit 3 detects the current flowing through the primary coil n1 of the inductance element L1 by using the secondary coil n2 of the inductance element L1, and controls an operation of the switching element Q1 in a critical mode where the switching element Q1 is turned on when the detected current becomes zero. Further, in the present embodiment, the voltage accumulated in the capacitor C2 by a positive voltage generated in the secondary coil n2 during a time period (between the time t1 and the time t2 in (a) of FIG. 2) during which charges accumulated in the primary coil n1 of the inductance element L1 are discharged is used as the operating voltage of the output control unit 3.

Figure 3:
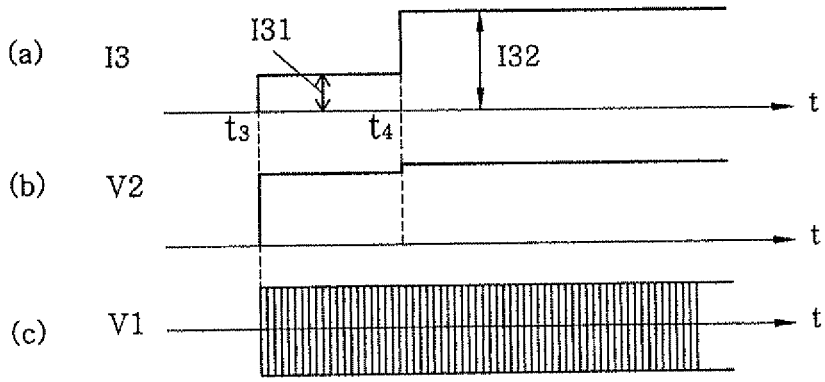
FIG. 3 shows more graphs for explaining an operation of the LED lighting device.

FIG. 3 shows graphs for explaining an operation of the LED lighting device. After a start-up control current is supplied from a start-up circuit (not shown) to the output control unit 3 by allowing the start-up circuit to be powered from the DC power supply 1, the output control unit 3 is driven to start a lighting operation at a time "t3" when a voltage, i.e., an initial operating voltage, supplied from the start-up circuit reaches a preset desired voltage. The control circuit 31 of the output control unit 3 creates a first control signal for adjusting a load current "I3" to be set at I31 and outputs the first control signal to the driving circuit 32. Then, the driving circuit 32 controls on and off time to decrease (ON time)/(ON and OFF period) of the switching element Q1 based on the first control signal outputted from the control circuit 31, and sets the load current I3 of the LED lamp 5 to I31.

Next, at a time "t4," the control circuit 31 creates a second control signal for adjusting the load current I3 to I32 (I32>I31) and outputs the second control signal to the driving circuit 32. Then, the driving circuit 32 controls the on and off time to increase (ON time)/(ON and OFF period) of the switching element Q1 based on the second control signal outputted from the control circuit 31, and sets the load current I3 of the LED lamp 5 to I32.

Specifically, in the present embodiment, the on and off time of the switching element Q1 is controlled in such a way that the load current I3 (=I31) of the LED lamp 5 during a first time period (between the time t3 and the time t4 in (a) of FIG. 3) becomes smaller than the load current I3 (=I32) of the LED lamp 5 during a second time period (after the time t4 in (a) of FIG. 3) in a steady state. As a result, when the lighting operation is started, the voltage of the capacitor C1 is rapidly increased, which causes a steep rise in the voltage generated in the secondary coil n2 of the inductance element L1. Accordingly, it is possible to reduce a time period that it takes for the operating voltage supplied from the control power supply unit 4 to the output control unit 3 to be stabilized.

In the first time period (between the time t3 and the time t4), as for the voltage generated in the secondary coil n2 of the inductance element L1, a rate of a period during which the positive voltage is generated is increased as the (ON time)/

(ON and OFF period) of the switching element Q1 is decreased and, thus, the current supplied from the control power supply unit 4 to the output control unit 3 becomes increased. Accordingly, it is possible to considerably reduce the time period that it takes for the operating power to be stabilized.

Further, in the second time period (after the time t4), the rate of the period during which the positive voltage is generated is decreased as (ON time)/(ON and OFF period) of the switching element Q1 is increased and, thus, the current supplied from the control power supply unit 4 to the output control unit 3 becomes decreased. Accordingly, it is possible to reduce a power loss in the output control unit 3 or the control power supply unit 4.

During the lighting operation, the voltage caused by the load current of the LED lamp 5 is fed back to the control circuit 31, and the control circuit 31 creates a control signal for adjusting the voltage value to a preset desired value and outputs the control signal to the driving circuit 32. Then, the driving circuit 32 controls the on and off time of the switching element Q1 based on the control signal outputted from the control circuit 31 to set the load current I3 of the LED lamp 5 to a preset desired value (e.g., I31 or I32 in the present embodiment).

In the present embodiment, the start-up circuit may have any configuration as far as it can supply an operation power voltage to the output control unit 3 between the time when the operation power voltage is supplied and the time when the lighting operation is started.

Figure 4:
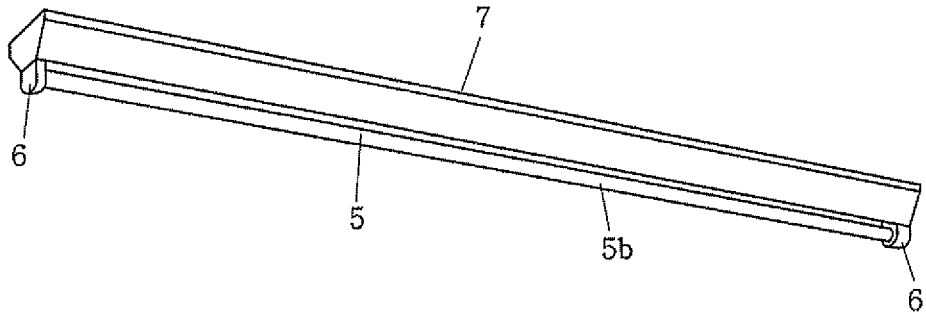
FIG. 4 is a perspective view showing an outer appearance of an illumination apparatus including the LED lighting device.

FIG. 4 is a perspective view showing an outer appearance of an illumination apparatus of the present embodiment. The illumination apparatus includes the aforementioned LED lighting device; a pair of lamp sockets 6 to which the LED lamp 5 is mechanically electrically connected; and an apparatus body 7 directly attached to the ceiling surface.

The apparatus body 7 has a long angular tubular shape with a trapezoid side surface when viewed in a longitudinal direction thereof, and serves to accommodate the LED lighting device therein. Moreover, the lamp sockets 6 are respectively arranged at opposite ends on the bottom of the apparatus body 7 in its longitudinal direction.

The lamp sockets 6 have the same configuration as the lamp sockets for the straight tubular fluorescent lamp, which is conventionally known. The LED lamp 5 is mechanically electrically connected to the lamp sockets 6 by respectively putting caps (not shown) provided at opposite ends of the LED lamp 5 into the lamp sockets 6.

Therefore, by using the aforementioned LED lighting device, it is possible to provide an illumination apparatus capable of reducing a time period that it takes for an operation power of the output control unit 3 to be stabilized.

While the invention has been shown and described with respect to the embodiments, it will be understood by those skilled in the art that various changes and modifications may be made without departing from the scope of the invention as defined in the following claims.

What is claimed is:

1. An LED lighting device comprising:

a power converting unit configured to convert a power source voltage to a DC voltage and output the DC voltage to an LED unit; and an output control unit configured to control an output of the power converting unit, wherein the power converting unit has a chopper circuit including a series circuit of a primary coil of an inductance element and a capacitor; a switching element which is connected to the primary coil of the inductance element in series and turned on and off by the output control unit; and a diode serving as a discharging path of the primary coil of the inductance element during an OFF state of the switching element, wherein an operating voltage of the output control unit is obtained from a voltage generated in a secondary coil of the inductance element, and the output control unit controls an on-duty ratio of the switching element during an initial time period after a lighting operation is started to be smaller than that during a steady state of the lighting operation so that a current supplied to the LED unit during the initial time period is smaller than that during the steady state.

2. The device of claim 1, wherein the operating voltage of the output control unit is obtained from a positive voltage generated in the secondary coil when charges accumulated in the inductance element are discharged.

3. The device of claim 1, wherein the output control unit controls the operation of the switching element in a critical mode where the switching element is turned on at the time when a current flowing through the primary coil of the inductance element becomes zero, and uses the secondary coil to detect the current flowing through the primary coil of the inductance element.

4. The device of claim 2, wherein the output control unit controls the operation of the switching element in a critical mode where the switching element is turned on at the time when a current flowing through the primary coil of the inductance element becomes zero, and uses the secondary coil to detect the current flowing through the primary coil of the inductance element.

5. An illumination apparatus comprising:

the LED lighting device of claim 1;

lamp sockets to which the LED unit is mechanically electrically connected; and an apparatus body for holding the LED lighting device and the lamp sockets.

6. An illumination apparatus comprising:

the LED lighting device of claim 2;

lamp sockets to which the LED unit is mechanically electrically connected; and an apparatus body for holding the LED lighting device and the lamp sockets.

7. An illumination apparatus comprising:

the LED lighting device of claim 3;

lamp sockets to which the LED unit is mechanically electrically connected; and an apparatus body for holding the LED lighting device and the lamp sockets.

8. An illumination apparatus comprising:

the LED lighting device of claim 4;

lamp sockets to which the LED unit is mechanically electrically connected; and an apparatus body for holding the LED lighting device and the lamp sockets.

* * * * *